US008267497B2

(12) United States Patent
Hirota

(10) Patent No.: US 8,267,497 B2
(45) Date of Patent: Sep. 18, 2012

(54) LIQUID EJECTING APPARATUS AND METHOD OF CONTROLLING THE SAME

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 528 days.

(21) Appl. No.: 12/503,873

(22) Filed: Jul. 16, 2009

(65) Prior Publication Data

US 2010/0182364 A1 Jul. 22, 2010

(30) Foreign Application Priority Data

Aug. 26, 2008 (JP) ..... 2008-217189

(51) Int. Cl.
*B41J 29/38* (2006.01)

(52) U.S. Cl. ..... 347/14; 347/5; 347/6; 347/20; 347/23

(58) Field of Classification Search ..... 347/5–6, 347/14, 20, 23
See application file for complete search history.

(56) References Cited

U.S. PATENT DOCUMENTS

| | | | | |
|---|---|---|---|---|
| 4,797,686 | A * | 1/1989 | Holder | 347/6 |
| 6,231,174 | B1 * | 5/2001 | Haigo | 347/89 |
| 2005/0062815 | A1 | 3/2005 | Yoshihira et al. | |
| 2005/0146545 | A1 * | 7/2005 | Richards | 347/14 |
| 2006/0103700 | A1 | 5/2006 | Taira | |
| 2007/0252860 | A1 * | 11/2007 | Nitta et al. | 347/14 |
| 2008/0246792 | A1 * | 10/2008 | Bibl et al. | 347/14 |
| 2009/0219320 | A1 * | 9/2009 | Shimizu | 347/14 |
| 2009/0278880 | A1 * | 11/2009 | Dijksman et al. | 347/14 |
| 2010/0321424 | A1 * | 12/2010 | Tamaki | 347/6 |

FOREIGN PATENT DOCUMENTS

| | | | |
|---|---|---|---|
| EP | 1525985 | A1 | 4/2005 |
| EP | 1658978 | A1 | 5/2006 |
| JP | 2000033714 | A * | 2/2000 |
| JP | 2005-125670 | | 5/2005 |
| JP | 2006-168339 | | 6/2006 |

OTHER PUBLICATIONS

Extended EP Search Report dtd Dec. 16, 2009, EP Appln. 09164398.1.
EP Office Action dtd May 26, 2011, EP Application No. 09164398.1.

* cited by examiner

*Primary Examiner* — Ryan Lepisto
*Assistant Examiner* — Guy Anderson
(74) *Attorney, Agent, or Firm* — Banner & Witcoff, Ltd.

(57) ABSTRACT

A liquid ejecting apparatus including a liquid ejecting head having a supply portion, an ejecting portion, a discharge portion, and a filter portion dividing an internal passage within the head into an upstream passage communicating with the supply and discharge portions and a downstream passage communicating with the ejecting portion, and further including pumps respectively connected to the supply and discharge portions. The apparatus includes, and a control portion configured to control the pumps so as to satisfy a mathematical relationship among parameters, during a maintenance operation to discharge a supplied liquid from the discharge portion through the upstream passage. A method is also provided to control the liquid ejecting apparatus.

30 Claims, 7 Drawing Sheets

LIQUID EJECTING APPARATUS AND METHOD OF CONTROLLING THE SAME

CROSS REFERENCE TO RELATED APPLICATION

The present application claims the priority from Japanese Patent Application No. 2008-217189 filed Aug. 26, 2008, the disclosure of which is herein incorporated by reference in its entirety.

BACKGROUND OF THE INVENTION

1. Field of the Invention

The present invention relates to a liquid ejecting apparatus, and a method of controlling the liquid ejecting apparatus during maintenance thereof.

2. Description of Related Art

An ink-jet printer is known as an example of a liquid ejecting apparatus. The ink-jet printer has an ink-jet head having a multiplicity of nozzles for ejecting droplets of an ink, a supply port for receiving the ink supplied from an ink supply source such as an ink reservoir, and an internal passage system connecting the input port to the nozzles.

Such a printer is arranged to perform a maintenance operation such as a purging operation, for maintaining a good condition of ejection of the ink droplets from the head. US 2006/0103700 A1 (corresponding to JP-2006-168339 A) discloses an example of such a maintenance operation, that is, techniques of removing foreign matters such as dust and air bubbles existing within the head, to maintain the head, by performing a purging operation in which the ink is forcibly ejected from the nozzles, and a reverse purging operation in which the ink is pressurized and sucked from the nozzles and discharged from a discharge port.

For maintaining the head, it is considered to suck the ink into the head through the supply port and discharge the ink through the discharge port, without the ink being ejected from the nozzles. During this maintenance operation, it is desirable that meniscus at the nozzles is maintained without destruction due to the maintenance operation. The destruction of the meniscus at the nozzles would result in leakage of the ink from the nozzles, and adhesion of the ink to an ejection surface of the head in which the nozzles are open, giving rise to a risk of contamination of a recording medium and an internal structure of the printer with the ink. Further, the destruction of the meniscus would cause the foreign matters to move toward the nozzles, leading to instability of ejection of the ink droplets from the nozzles, namely, defective ejection of the ink droplets after the maintenance operation.

In the head wherein a filter is provided to divide the internal passage system into an upstream passage portion and a downstream passage portion, as disclosed in the above-disclosed publication US 2006/0103700 A1, it is desirable that the maintenance operation described above does not cause the foreign matters to enter into the downstream passage portion through the filter. The entry of the foreign matters into the downstream passage portion would result in a problem of defective ejection of ink from the nozzles such as failure or instability of the ink ejection.

SUMMARY OF THE INVENTION

The present invention was made in view of the background art described above. It is therefore a first object of the present invention to provide a method of controlling a liquid ejecting apparatus, which alleviates the problem of instability of ejection of the ink droplets after the maintenance operation of the apparatus. A second object of this invention is to provide a liquid ejecting apparatus which alleviates the above-indicated problem.

The first object indicated above can be achieved according to a first aspect of the present invention, which provides a method of controlling a liquid ejecting apparatus including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, and an internal passage including a passage extending from the liquid supply portion to the liquid ejecting portion through an intermediate part, and a passage extending from the intermediate part to the liquid discharge portion, and (b) a pressurizing portion configured to apply a pressure to at least one of the liquid supply portion and the liquid discharge portion, the method comprising:

controlling the pressurizing portion so as to satisfy the following formulas (1) and (2), during a maintenance operation wherein the liquid supplied through the liquid supply portion is discharged from the liquid discharge portion, without a flow of the liquid through the liquid ejecting portion, $$-P_0'(R_1+R_2)<P_1R_2+P_2R_1<P_0(R_1+R_2) \quad \text{formula (1)}$$

$$P_1-P_2>Q_0(R_1+R_2) \quad \text{formula (2)}$$

wherein $P_0$: meniscus-withstanding pressure withstanding a pressure acting on a meniscus of the liquid ejecting portion in a direction from a side of the liquid toward a side of an atmosphere, $P_0'$: meniscus-withstanding pressure withstanding a pressure acting on the meniscus of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_1$: liquid flow resistance in a passage from the liquid supply portion to the intermediate part of the internal passage, $R_2$: liquid flow resistance in a passage from the intermediate part of the internal passage to the liquid discharge portion, and $Q_0$: minimum amount of liquid supplied through the liquid supply portion and discharged through the liquid discharge portion, which minimum amount is required to discharge foreign matters existing in a passage from the liquid supply portion to the liquid discharge portion via the intermediate part during the maintenance operation.

According to the first aspect of this invention, it is possible to effectively prevent the destruction of the meniscus at the liquid ejecting portion, by controlling the pressurizing portion so as to satisfy the above-indicated formulas (1) and (2) during the maintenance operation. Accordingly, it is possible to prevent the leakage of the liquid from the liquid ejecting portion, and instability of ejection of the liquid from the liquid ejecting portion after the maintenance operation, and alleviate the problem of defective ejection of the liquid after the maintenance operation. Further, the ink discharged from the liquid discharge portion can be stored in a suitable reservoir, without the liquid leakage from the liquid ejecting portion during the maintenance operation, so that the liquid returned to the reservoir can be effectively reused.

The first object indicated above can also be achieved according to a second aspect of this invention, which provides a method of controlling a liquid ejecting apparatus (1) including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion, and (b) a pressurizing portion configured to apply a pressure to at least one of the liquid supply portion and the liquid discharge portion, the method comprising:

controlling the pressurizing portion so as to satisfy the following formulas (3) and (4), during a maintenance operation wherein the liquid supplied through the liquid supply portion is discharged from the liquid discharge portion through the upstream passage, $$-P_0'(R_3+R_4)<P_1R_4+P_2R_3<P_0(R_3+R_4) \quad \text{formula (3)}$$

$$P_1-P_2>Q_1(R_3+R_4) \quad \text{formula (4)}$$

wherein $P_0$: meniscus-withstanding pressure withstanding a pressure acting on a meniscus of the liquid ejecting portion in a direction from a side of the liquid toward a side of an atmosphere, $P_0'$: meniscus-withstanding pressure withstanding a pressure acting on the meniscus of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

The above-described method according to the second aspect of this invention is applicable to the liquid ejecting apparatus wherein the filter portion is provided in the internal passage within the liquid ejecting head. Like the first aspect, the present second aspect is also based on the meniscus-withstanding pressures at the liquid ejecting portion, to control the pressurizing portion so as to satisfy the above-indicated formulas (3) and (4) during the maintenance operation, for effectively preventing the destruction of the meniscus at the liquid ejecting portion. Further, the destruction of the meniscus at the filter portion is necessarily prevented by controlling the pressurizing portion so as to satisfy the above-indicated formulas (3) and (4), since the meniscus-withstanding pressure at the filter portion is generally higher than the meniscus-withstanding pressures at the liquid ejecting portion. Accordingly, the foreign matters such as air bubbles existing in the upstream passage will not enter into the downstream passage through the filter portion, so that it is possible to more effectively alleviate the problem of defective ejection of the liquid from the liquid ejecting portion after the maintenance operation.

The first object may also be achieved according to a third aspect of this invention, which provides a method of controlling a liquid ejecting apparatus including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion, and (b) a pressurizing portion configured to apply a pressure to at least one of the liquid supply portion and the liquid discharge portion, the method comprising:

controlling the pressurizing portion so as to satisfy the following formulas (5) and (6), during a maintenance operation wherein the liquid supplied through the liquid supply portion is discharged from the liquid discharge portion through the upstream passage, $$P_1R_4+P_2R_3<P_3(R_3+R_4) \quad \text{formula (5)}$$

$$P_1-P_2>Q_1(R_3+R_4) \quad \text{formula (6)}$$

wherein $P_1$: pressure at the liquid supply portion during the maintenance operation, $P_2$: pressure at the liquid discharge portion during the maintenance operation, $P_3$: meniscus-withstanding pressure at the filter portion, $R_3$: liquid flow resistance in a passage from the liquid supply portion to the filter portion, $R_4$; liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

The above-described method according to the third aspect of this invention is applicable to the liquid ejecting apparatus wherein the filter portion is provided in the internal passage within the liquid ejecting head. Unlike the first and second aspects, the present third aspect is based on the meniscus-withstanding pressure at the filter portion, to control the pressurizing portion so as to satisfy the above-indicated formulas (5) and (6) during the maintenance operation, for preventing the destruction of the meniscus at the filter portion. Accordingly, the foreign matters such as air bubbles existing in the upstream passage will not enter into the downstream passage through the filter portion, so that it is possible to effectively alleviate the problem of defective ejection of the liquid from the liquid ejecting portion after the maintenance operation. In addition, a difference between the pressures $P_1$, $P_2$ has a larger amount of tolerance in the present aspect of the invention, than in the above-described first and second aspects of the invention which are based on the meniscus-withstanding pressure at the liquid ejecting portion. Accordingly, the operation to control the liquid pressures at the liquid supply and discharge portions can be made easier, and a controller to control the pressurizing portion can be made simpler in construction and more inexpensive.

The second object may be achieved according to a fourth aspect of this invention, which provides a liquid ejecting apparatus comprising: a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, and an internal passage including a passage extending from the liquid supply portion to the liquid ejecting portion through an intermediate part, and a passage extending from the intermediate part to the liquid discharge portion; a pressurizing portion configured to apply a pressure to at least one of the liquid supply portion and the liquid discharge portion: and a control portion configured to control the pressurizing portion so as to satisfy the following formulas (1) and (2), during a maintenance operation wherein the liquid supplied through the liquid supply portion is discharged from the liquid discharge portion, without a flow of the liquid through the liquid ejecting portion, $$-P_0'(R_1+R_2)<P_1R_2+P_2R_1<P_0(R_1+R_2) \quad \text{formula (1)}$$

$$P_1-P_2>Q_0(R_1+R_2) \quad \text{formula (2)}$$

wherein $P_0$: meniscus-withstanding pressure withstanding a pressure acting on a meniscus of the liquid ejecting portion in a direction from a side of the liquid toward a side of an atmosphere, $P_0'$: meniscus-withstanding pressure withstanding a pressure acting on the meniscus of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_1$: liquid flow resistance in a passage from the liquid supply portion to the intermediate part of the internal passage, $R_2$: liquid flow resistance in a passage from the intermediate part of the internal passage to the liquid discharge portion, and $Q_0$: minimum amount of liquid supplied through the liquid supply portion and discharged through the liquid discharge portion, which minimum amount is required to discharge foreign matters existing in a passage from the liquid supply portion to the liquid discharge portion via the intermediate part during the maintenance operation.

The second object may also be achieved according to a fifth aspect of this invention, which provides a liquid ejecting apparatus comprising: a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion; a pressurizing portion configured to apply a pressure to at least one of the liquid supply portion and the liquid discharge portion; and a control portion configured to control the pressurizing portion so as to satisfy the following formulas (3) and (4), during a maintenance operation wherein the liquid supplied through the liquid supply portion is discharged from the liquid discharge portion through the upstream passage, $$-P_0'(R_3+R_4)<P_1R_4P_2R_3<P_0(R_3+R_4) \quad \text{formula (3)}$$

$$P_1-P_2>Q_1(R_3+R_4) \quad \text{formula (4)}$$

wherein $P_0$: meniscus-withstanding pressure withstanding a pressure acting on a meniscus of the liquid ejecting portion in a direction from a side of the liquid toward a side of an atmosphere, $P_0'$: meniscus-withstanding pressure withstanding a pressure acting on the meniscus of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

The second object may also be achieved according to a sixth aspect of this invention, which provides a liquid ejecting apparatus comprising: a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion; a pressurizing portion configured to apply a pressure to at least one of the liquid supply portion and the liquid discharge portion; and a control portion configured to control the pressurizing portion so as to satisfy the following formulas (5) and (6), during a maintenance operation wherein the liquid supplied through the liquid supply portion is discharged from the liquid discharge portion through the upstream passage, $$P_1R_4+P_2R_3<P_3(R_3+R_4) \quad \text{formula (5)}$$

$$P_1-P_2>Q_1(R_3+R_4) \quad \text{formula (6)}$$

wherein $P_1$: pressure at the liquid supply portion during the maintenance operation, $P_2$: pressure at the liquid discharge portion during the maintenance operation, $P_3$: meniscus-withstanding pressure at the filter portion, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

The fourth, fifth and sixth aspects of the invention respectively correspond to the first, second and third aspects of the invention described above, and provide substantially the same advantages as the first, second and third aspects.

BRIEF DESCRIPTION OF THE DRAWINGS

The above and other objects, features, advantages and technical and industrial significance of the present invention will be better understood by reading the following detailed description of a preferred embodiment of the present invention, when considered in connection with the accompanying drawings, in which.

DETAILED DESCRIPTION OF THE PREFERRED EMBODIMENTS

One preferred embodiment of the present invention will be described by reference to the drawings.

Figure 1:
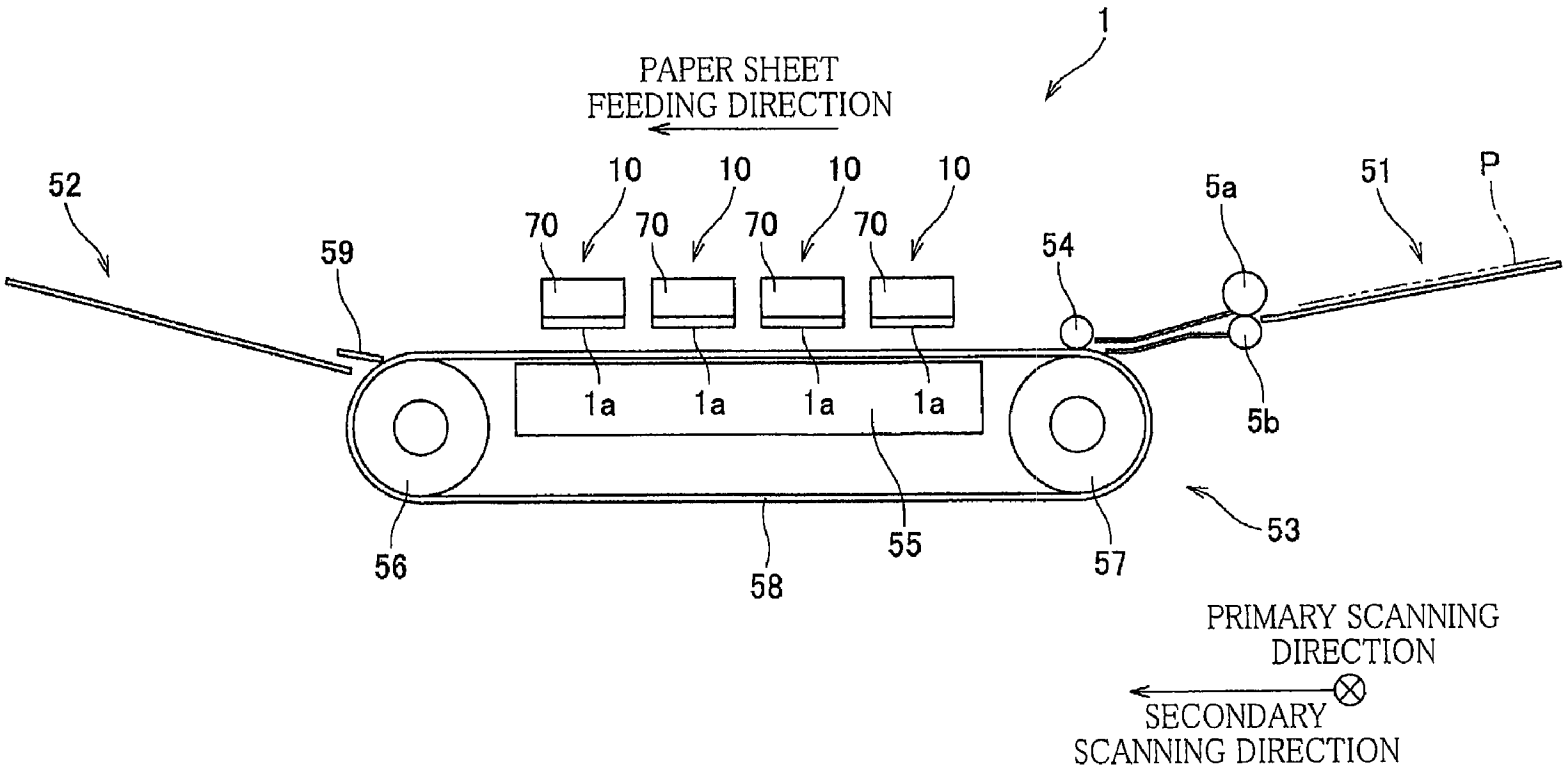
FIG. 1 is a schematic side elevational view of a liquid ejecting apparatus in the form of an ink-jet printer constructed according to one embodiment of the present invention.

Referring first to the elevational view of FIG. 1, there is schematically shown a liquid ejecting apparatus in the form of an ink-jet printer 1 constructed according to the embodiment of this invention.

The ink-jet printer 1 is a color ink-jet line printer having four ink-jet heads 10 fixed to a main body thereof, as shown in FIG. 1. The four ink-jet heads 10 are provided to eject respective four different colors of ink, that is, magenta, yellow, cyan and black inks. The ink-jet printer 1 has a sheet feeding path extending from a sheet supply portion 51 located on its right side as seen in FIG. 1, to a sheet discharge portion 51 located on its left side as seen in FIG. 1. A sheet of paper P is fed by a pair of nip rollers 5*a*, 5*b* from the sheet supply portion 51 into a sheet feeding unit 53 while the paper sheet P is nipped by the nip rollers 5*a*, 5*b*.

The sheet feeding unit 53 includes two belt rollers 56, 57, an endless feeding belt 58 connecting the two belt rollers 56, 57, and a platen 55 which is located within a loop of the feeding belt 58, in an opposed relation with the four ink-jet heads 10, for supporting an upper span of the feeding belt 58 so as to prevent downward deflection of the upper span. A presser roller 54 is disposed in an opposed relation with the belt roller 57, with the right end of the loop of the feeding belt 58 being sandwiched between the rollers 54, 57, so that the paper sheet P fed from the sheet supply portion 51 is pressed against the upper surface of the upper span of the feeding belt 58. The outer circumferential surface of the feeding belt 58 is provided with a slightly tacky silicone resin layer, so that the paper sheet P is fed toward the discharge portion 52, while the paper sheet P is held on the upper surface of the upper span of the feeding belt 58, with a force of adhesion owing to the tacky silicone resin.

A separator plate 59 is disposed at a position along the sheet feeding path, immediately downstream of the feeding belt 58. The separator plate 59 is provided to separate the paper sheet P from the outer circumferential surface of the feeding belt 58, and to feed the separated paper sheet P to the discharge portion 52.

Figure 4:
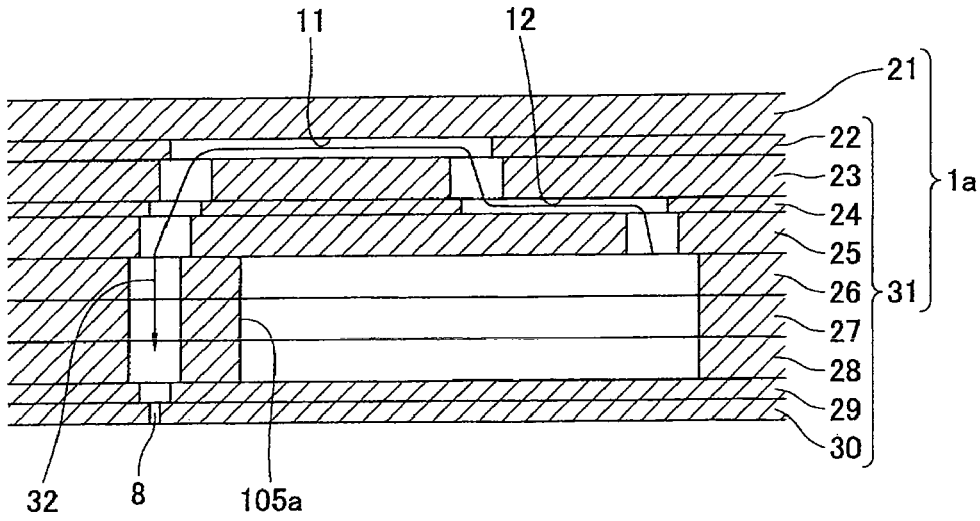
FIG. 4 is a fragmentary cross sectional view of the main body of the head.

Each of the four heads 10 is elongate in a primary scanning direction of the ink-jet printer 1, and has a main body 1*a* as its lower section. As described below, the main body 1*a* is provided with a passage unit 31 which has a lower surface in which a multiplicity of nozzles 8 functioning as a liquid ejecting portion are open as shown in FIG. 4. The paper sheet P is fed by the feeding belt 58, right blow the four heads 10, so that droplets of the inks of the different colors are ejected from the nozzles 8 of the four heads 10, onto the upper surface of the paper sheet P, whereby a desired color image is formed on the upper surface of the paper sheet P.

Figure 2:
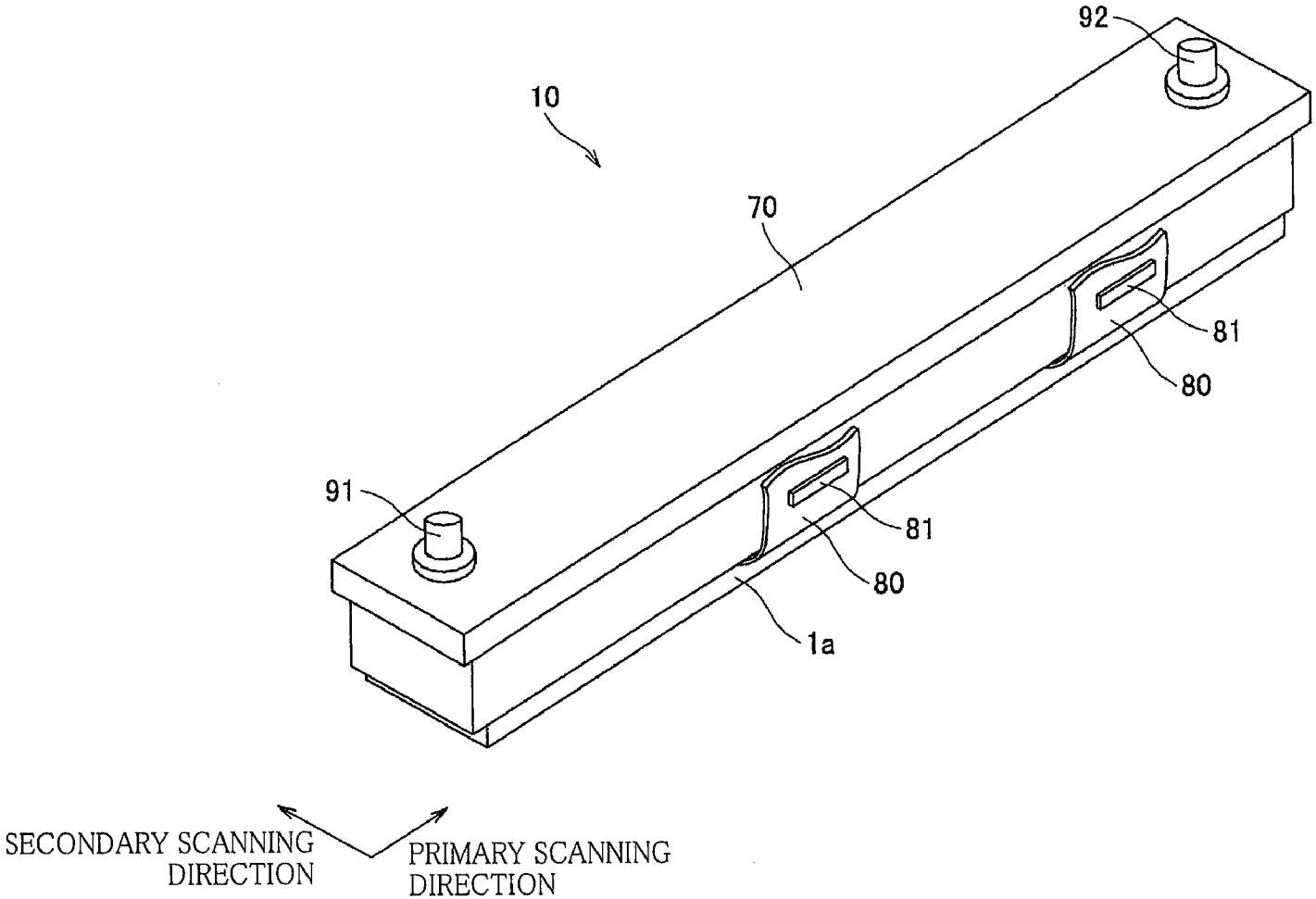
FIG. 2 is a perspective view of one of heads of the ink-jet printer of FIG. 1.
Figure 3:
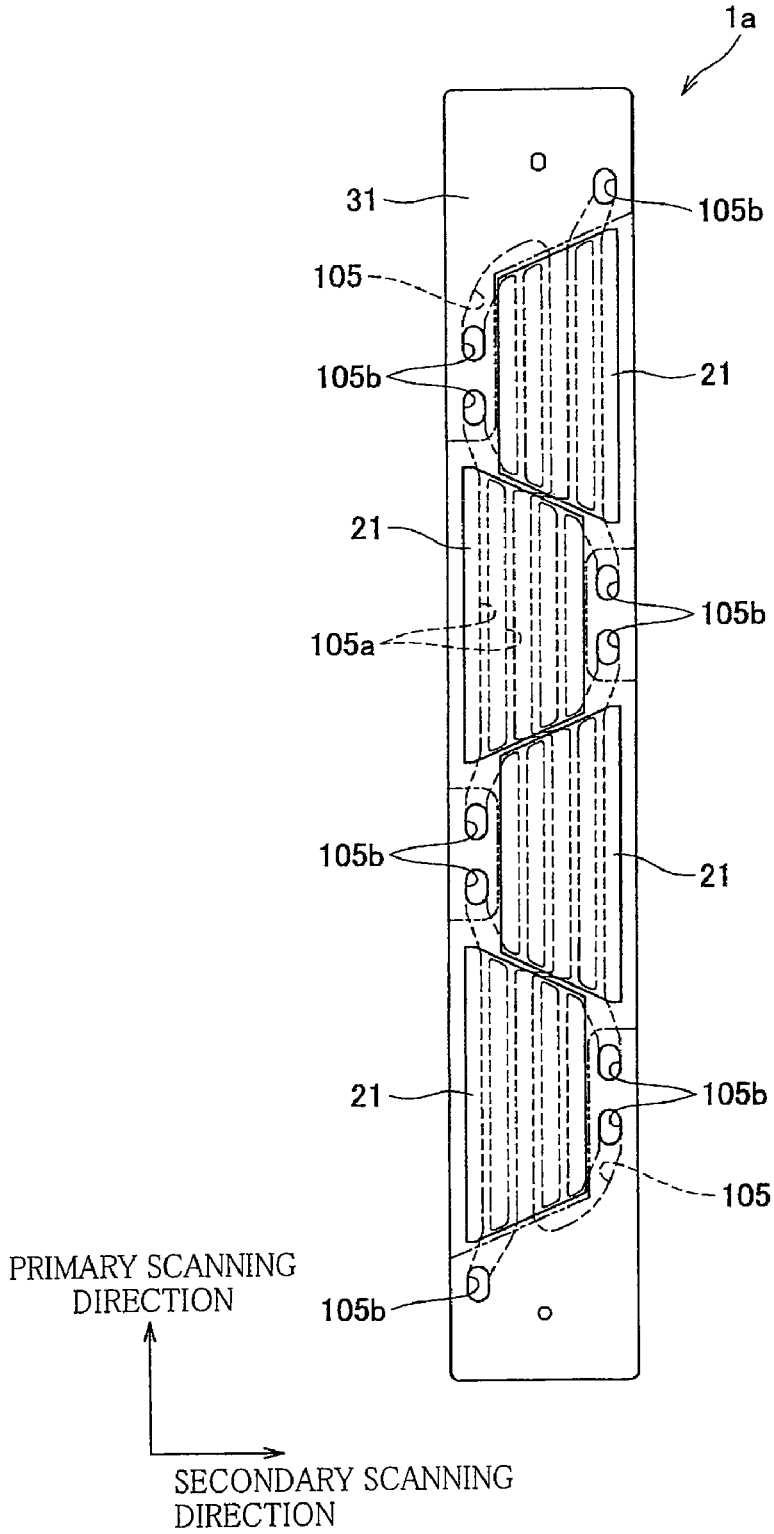
FIG. 3 is a plan view of a main body of the head of FIG. 2.

Referring next to FIGS. 2, 3 and 4, an arrangement of each head 10 will be described in greater detail.

As shown in FIG. 2, the head 10 has the lower main body 1*a*, and an upper reservoir unit 70. The main body 1*a* includes the passage unit 31 having a lower surface in which the multiple ink ejecting nozzles 8 are open as shown in FIG. 4., and further includes four actuator units 21 bonded to an upper surface of the passage unit 31, as shown in FIG. 3. The reservoir unit 70 is provided to temporarily accommodate the ink and to supply the ink to the passage unit 31.

The reservoir unit 70 is laminated on the upper surface of the passage unit 31, such that the reservoir unit 70 cooperates with the passage unit 31 to sandwich the actuator units 21. The reservoir unit 70 is disposed on the upper surface of the passage unit 31, so as to avoid interference with the actuator units 21, and so as to be opposed to the actuator units 21 with a small gap left therebetween in the direction of lamination of the reservoir unit 70 and the actuator units 21. Each actuator unit 21 is connected at a surface thereof to one end of a flexible printed circuit (FPC) 80. The FPC 80 is formed to run between the passage unit 21 of the main body 1*a* and the reservoir unit 70, and to extend upwards, and is connected at the other end to a control circuit board (not shown). The FPC 80 is provided with a driver IC 81 at its surface area between the actuator unit 21 and the control circuit board. Namely, the FPC 80 is electrically connected to the control circuit board and the driver IC 81, so that an image signal generated from the control circuit board is fed to the driver IC 81, and a drive signal generated from the driver IC 81 is supplied to the actuator unit 21. With the actuator unit 21 actuated according to the drive signal, the ink droplets are ejected from the selected nozzles 8 open in the lower surface of the passage unit 31.

Reference is now made to FIGS. 3 and 4 showing an arrangement of the passage unit 31. As shown in FIG. 4, the passage unit 31 consists of nine metal plates 22, 23, 24, 25, 26, 27, 28, 29 and 30 each of which has multiple through-holes and which are laminated or superposed on each other in a predetermined positional relationship with each other.

Figure 6:
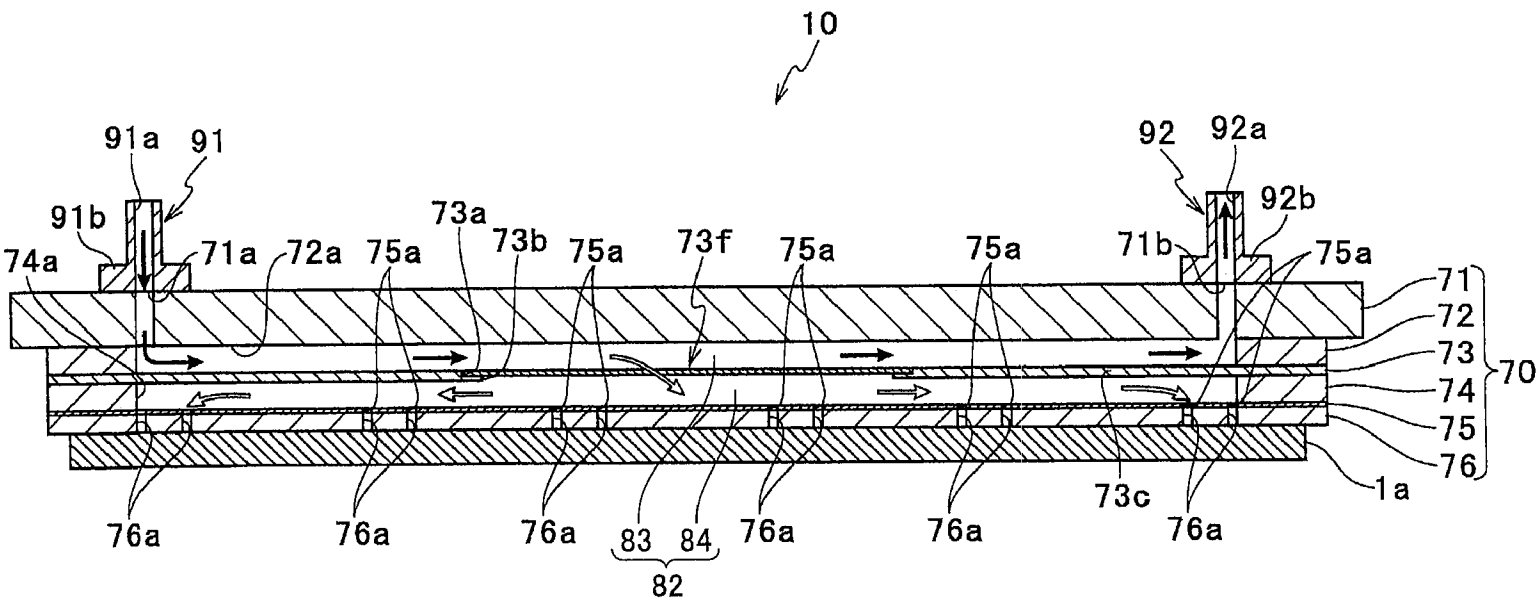
FIG. 6 is a longitudinal cross sectional view of a reservoir unit provided in the head of FIG. 2.

The multiple nozzles 8 shown in FIG. 4 are formed in a matrix in the passage unit 31 such that the nozzles 8 are open in areas of the lower surface of the lowest metal plate 30 of the passage unit 31, which areas correspond to the four actuator units 21. The uppermost metal plate 22 of the passage unit 31 cooperates with the four actuator units 21 to define multiple pressure chambers 11 corresponding to the respective nozzles 8, such that the pressure chambers 11 are formed in a matrix like the nozzles 8. As shown in FIG. 3, the passage unit 31 further has openings 105*b* which are open in the upper surface of its uppermost metal plate 22 and which communicate with respective circular holes 76*a* formed in the reservoir unit 70 as shown in FIG. 6. The passage unit 31 further has manifold passages 105 communicating with the openings 105*b*, auxiliary manifold passages 105*a* extending from the manifold passages 105 in the primary scanning direction, and multiple individual ink passages 32 which extend from the auxiliary manifold passages 105*a* and which communicate with the respective nozzles 8. The reservoir unit 70 is laminated on the passage unit 31 such that the circular holes 76*a* are held in communication with the respective openings 10*b* of the passage unit 31.

The ink supplied from the reservoir unit 70 to the passage unit 31 flows through the manifold passages 105 into the auxiliary manifold passages 105*a*. As shown in FIG. 4, the passage unit 31 further has apertures 12 formed through the metal plates 23-25. The ink flows from the auxiliary manifold passages 105*a* into the respective apertures 12 and the corresponding pressure chambers 11, and is ejected from the respective nozzles 8. As is understood from the foregoing description, each of the individual ink passages 32 formed through the passage unit 31 extends from the corresponding auxiliary manifold passage 105*a* to the corresponding nozzle 8, via the corresponding aperture 12 and pressure chamber 11.

Figure 5:
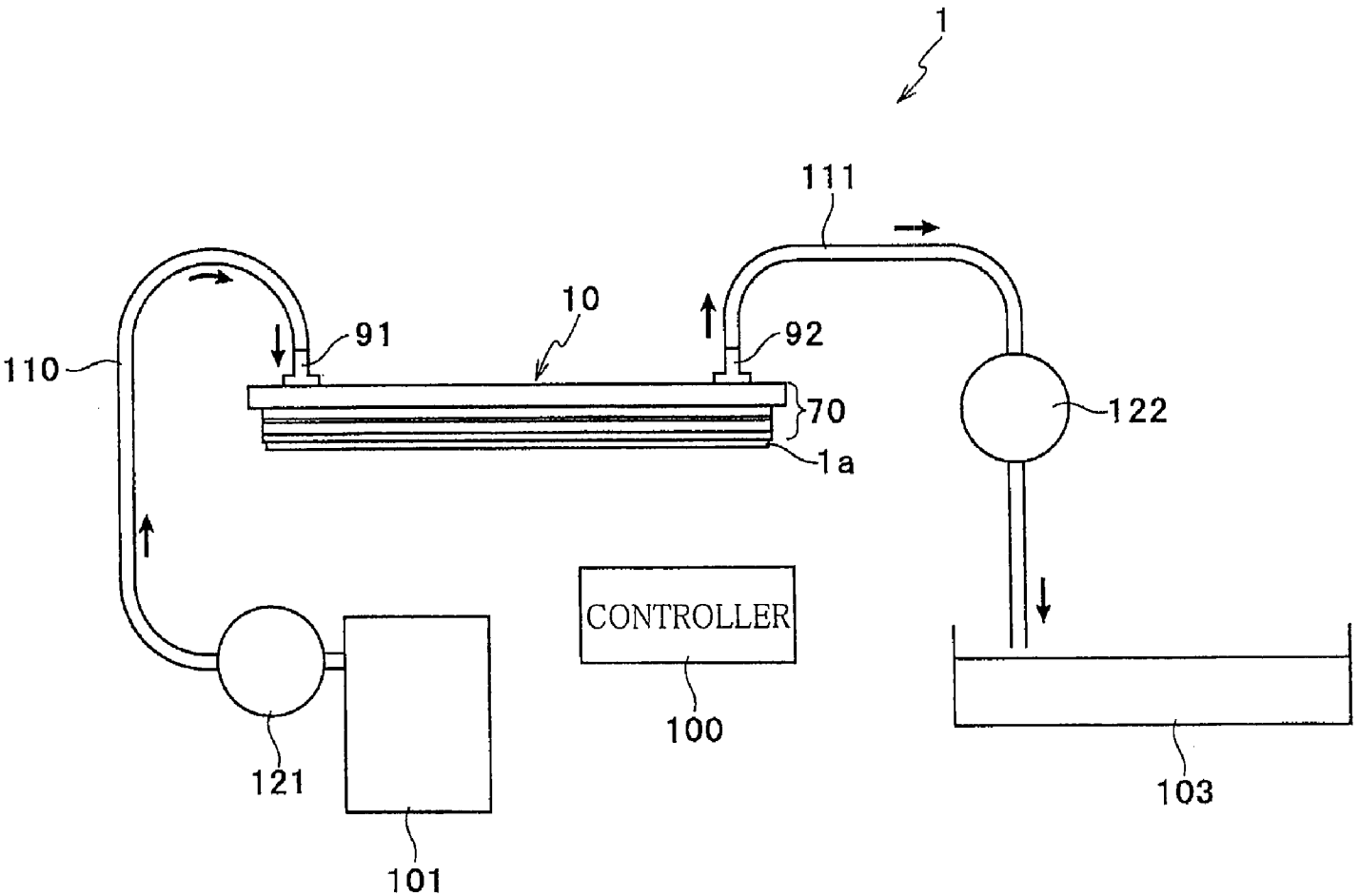
FIG. 5 is a schematic view showing an ink supply and discharge system of the ink-jet printer of FIG. 1.

Referring next to FIGS. 5 and 6, there will be described an ink supply and discharge system of the printer 1 and an arrangement of the reservoir unit 70.

As shown in FIG. 6, the reservoir unit 70 has an ink supply port 71*a* and an ink discharge port 71*b* open at respective opposite ends of its upper surface as seen in the primary scanning direction. The ink supply port 71*a* functions as a liquid supply portion while the ink discharge port 71*b* functions as a liquid discharge portion. As shown in FIGS. 5 and 6, the reservoir unit 70 has a supply joint 91 communicating with the ink supply port 71*a*, and a discharge joint 92 communicating with the ink discharge port 71*b*. The supply and discharge joints 91, 92 are connected to respective tubes 110, 111. The ink-jet printer 1 includes an ink reservoir 101 for storing the ink to be supplied to each of the ink-jet heads 10, a waste reservoir 103 for storing the ink discharged from the heads 10 during the maintenance operation of the ink-jet printer 1, a pressurizing pump 121 disposed between the ink reservoir 101 and each head 10, and a suction pump 122 disposed between the waste reservoir 103 and each head 10. The ink reservoir 101 functions as an external liquid source which is provided outside the head 10 and from which the ink is supplied to the ink supply port 71*a*. The head 10 is connected to the ink reservoir 101 through the tube 110, and to the waste reservoir 103 through the tube 111, as shown in FIG. 5.

As shown in FIG. 6, the reservoir unit 70 consists of six plates 71, 72, 73, 74, 75 and 76 each of which has a rectangular shape elongate in the primary scanning direction and which are laminated or superposed on each other in a predetermined positional relationship with each other.

The uppermost or first plate 71 has two circular holes formed at the respective opposite ends as seen in the primary scanning direction, such that these two circular holes are open in the upper surface of the first plate 71, as the above-indicated ink supply port 71*a* and ink discharge port 71*b*. The supply and discharge joints 91, 92 are fixed to the upper surface of the first plate 71 such that the joints 91, 92 communicate with the respective ink supply and discharge ports 71*a*, 71*b*. Each of the joints 91, 92 has a proximal fixed end 91*b*, 92*b* having a relatively large outside diameter, and a cylindrical bore 91*a*, 92*a* formed so as to extend from the proximal fixed end 91*b*, 92*b* to the distal free end. The joints 91, 92 are fixed to the upper surface of the first plate 71 such that the cylindrical bores 91*a*, 92*a* open in the lower surface of the proximal fixed end 91*b*, 92*b* communicate with the respective ink supply and discharge ports 71*a*, 71*b*.

The second plate 72 as counted from the uppermost first plate 71 has a through-hole extending from the circular hole having the ink supply port 71*a* of the first plate 71 to the circular hole having the ink discharge port 71*b*. This through-hole serves as an upstream ink reservoir 72*a*.

The third plate 73 as counted from the first plate 71 has a through-hole 73*b* formed in an almost central part thereof. This through-hole 73*b* has a circumferential upper edge which defines a shoulder 73*a*. The third plate 73 is provided with a filter 73*f* fixed to the shoulder 73*a*.

The fourth plate 74 as counted from the first plate 71 has a through-hole which serves as a downstream ink reservoir 74*a*. Described more specifically, the downstream ink reservoir 74*a* has a main passage portion extending in the primary scanning direction, and branch passage portions diverging from the main passage portion.

The fifth plate 75 as counted from the first plate 71 has a plurality of pairs of circular holes 75*a* formed at respective positions corresponding to the end sections of the respective branch passage portions of the downstream ink reservoir 74*a*.

The sixth plate 76 as counted from the first plate 71 has the circular holes 76*a* described above with respect to the openings 105*b* of the passage unit 31. The circular holes 76*a* are held in communication with the respective circular holes 75*a* of the fifth plate 75. Described in greater detail, the lower surface of the sixth plate 76 is subjected to a half-etching operation so that only those parts of the sixth plate 76 which define the lower end portions of each pair of circular holes 76*a* projects downwards such that the sixth plate 76 is fixed to the upper surface of the passage unit 31, at only the downwardly projecting parts of the lower surface of the sixth plate 76, while the other parts of the lower surface is held apart from the upper surface of the passage unit 31. However, this structural arrangement of the sixth plate 76 is not shown in FIG. 6.

The present ink-jet printer 1 is configured to perform a maintenance operation for assuring a good condition of ejection of the ink from the heads 10. For example, the maintenance operation is performed before the ink is introduced into each heads 10 from the ink reservoir 101 upon initial use of the ink-jet printer 1, or upon operation of the ink-jet printer 1 after a long period of rest.

During the maintenance operation, the pressurizing pump 121 and the suction pump 122 are operated to feed the ink from the ink reservoir 101 into the heads 10, and to discharge the ink from the heads 10 into the waste reservoir 103, as indicated by black arrows in FIG. 5.

Within each head 10, the ink which has been introduced into the upstream ink reservoir 72*a* through the cylindrical bore 91*a* of the supply joint 91 and the ink supply port 71*a* is fed in the horizontal direction through the upstream ink reservoir 72*a*, without a flow of the ink through the filter 73*f*, and is discharged through the ink discharge port 71*b* and the cylindrical bore 92*a* of the discharge joint 92, as indicated by black arrows in FIG. 6. At this time, air bubbles existing in the passage system and foreign matters such as dust deposited on the filter 73*f* are discharged together with the ink.

In FIG. 6, white arrows indicate flows of the ink during a normal printing or recording operation of the ink-jet printer 1. Namely, the ink which has been introduced into the upstream ink reservoir 72*a* through the ink supply port 71*a* is fed through the filter 73*f* into the downstream ink reservoir 74*a*, and is then fed into the passage unit 31 through the branch passage portions and the circular holes 75*a*, 76*a*. The ink fed into the passage unit 31 is ejected from the selected nozzles 8 through the corresponding individual ink passages 32, according to the operations of the actuator units 21. It is noted that the introduction of the ink into the ink supply port 71*a* takes place naturally, that is, without an operation of the pressurizing pump 121, owing to a negative pressure generated as a result of ejection of the ink from the nozzles 8.

In the present embodiment of the invention, the pressurizing pump 121 and the suction pump 122 are controlled by a control portion in the form of a controller 100 (shown in FIG. 5) of the printer 1, so as to satisfy the following formulas (3) and (4). It will be understood that an internal passage 82 is provided by the passages (including the upstream and downstream ink reservoirs 72*a*, 74*a*) formed within the reservoir unit 70 and the passage (including the individual ink passages 32) formed within the passage unit 31, and that an upstream passage 83 is provided by the passage (including the upstream ink reservoir 72*a*) formed above the filter 73*f* shown in FIG. 6, while a downstream passage 84 is provided by the passage (including the downstream ink reservoir 74*a*). In other words, the upstream passage 83 is a part of the internal passage 82, which is intermediate between the filter 73*f* and the ink supply port 71*a* or ink discharge port 71*b*, while the downstream passage 84 is a part of the internal passage 82, which is intermediate between the filter 73*f* and the nozzles 8.

$$-P_0'(R_3+R_4)<P_1R_4+P_2R_3<P_0(R_3+R_4) \quad \text{Formula (3)}$$

$$P_1-P_2>Q_1(R_3+R_4) \quad \text{Formula (4)}$$

wherein $P_0$: meniscus-withstanding pressure withstanding a pressure acting on the meniscus of the nozzle 8 in a direction from the liquid side toward the atmosphere side, $P_0'$: meniscus-withstanding pressure withstanding a pressure acting on the meniscus of the nozzle in a direction from the atmosphere side toward the liquid side, $P_1$: pressure at the ink supply port 71*a* during the maintenance operation, $P_2$: pressure at the ink discharge port 71*b* during the maintenance operation, $R_3$: ink flow resistance in a passage from the ink supply port 71*a* to the filter 73*f*; $R_4$: ink flow resistance in a passage from the filter 73*f* to the ink discharge port 71*b*, and $Q_1$: minimum amount of ink supplied through the ink supply port 71*a* and discharged through the ink discharge port 71*b*, which minimum amount is required to discharge the foreign matters existing in the upstream passage 83 during the maintenance operation. It is noted that the meniscus-withstanding pressures are pressure values in the internal passage 82 at which the meniscus of the nozzle 8 is destructed.

There will be described manners in which the above-indicated formulas (3) and (4) are obtained.

In the present embodiment wherein the filter 73*f* is provided in the internal passage 82 within the head 10, it is desirable that the foreign matters do not enter into the downstream passage 83 through the filter 73*f* during the maintenance operation. Accordingly, it is required to prevent a flow of the ink into the downstream passage 83 through the filter 73*f*. To prevent the flow of the ink through the filter 73*f* during the maintenance operation, the following formula (A) should be satisfied:

$$-P_0'<P<P_0, \quad \text{Formula (A)}$$

wherein P: pressure acting on the upper surface of the filter 73*f*

The pressure P has a positive value when the pressure P acts in the direction from the side of the head 10 toward the atmosphere side. Like the pressure P, the meniscus-withstanding pressures, which are physical values relating to only the magnitude of a force (withstanding force), are given the positive and negative signs when the meniscus-withstanding pressures are compared with characteristic values (pressure P) indicated together with the direction in which the force acts. The meniscus-withstanding pressures have negative values when the force acts in the direction from the atmosphere side toward the head side.

An amount q of the ink supplied through the ink supply port 71*a* and discharged from the ink discharge port 71*b* through the upstream passage 83 is represented by the following formula (B), and the pressure P acting on the upper surface of the filter 73*f* is represented by the following formula (C):

$$q=(P_1-P_2)/(R_3+R_4) \quad \text{Formula (B)}$$

$$P=P_2+qR_4 \quad \text{Formula (C)}$$

To discharge the foreign matters existing in the upstream passage 83, from the ink discharge port 71*b*, the above-indicated ink amount q should be larger than the above-indicated required minimum ink amount $Q_1$, so that the following formula (D) is obtained:

$$q>Q_1 \quad \text{Formula (D)}$$

The above-indicated formula (3) is obtained from the above-indicated formulas (A), (B) and (C), while the above-indicated formula (4) is obtained from the above-indicated formulas (B) and (D).

According to the present embodiment described above, it is possible to effectively prevent the destruction of the meniscus of the nozzles 8, by controlling the pressurizing pump 121 and the suction pump 122 so as to satisfy the above-indicated formulas (3) and (4), so that it is possible to prevent the ink leakage from the nozzles 8 and instability of ejection of the ink from the nozzles 8 after the maintenance operation, and to alleviate the problem of defective ejection of the ink after the maintenance operation.

The present embodiment is further configured such that the ink discharged from the ink discharge port 71*b* is stored in the waste reservoir 103 without the ink leakage from the nozzles 8 during the maintenance operation, so that the ink stored in the waste reservoir 103 can be effectively reused.

The present embodiment is also configured such that the destruction of the meniscus at the filter 73*f* is necessarily prevented by controlling the pumps 121, 122 so as to satisfy the above-indicated formulas (3) and (4), since the meniscus-withstanding pressure at the filter 73*f* is generally higher than the meniscus-withstanding pressures at the nozzles 8. Accordingly, the foreign matters existing in the upstream passage 83 will not enter into the downstream passage 84 through the filter 73*f*, so that it is possible to more effectively alleviate the problem of defective ejection of the ink from the nozzles 8 after the maintenance operation.

The pressures at the ink supply port 71*a* and the ink discharge port 71*b* can be efficiently controlled during the maintenance operation by controlling the pressurizing pump 121 and the suction pump 122 so as to satisfy the above-indicated formulas (3) and (4).

The pumps 121, 122 are provided as simple a pressurizing portion, so that the ink-jet printer 1 is accordingly simple in construction, easy to control and economical to manufacture.

In the present embodiment, the above-indicated formulas (3) and (4) are satisfied during the maintenance operation, by controlling the pressuring portion in the form of the pumps 121, 122. For example, the outputs of the pumps 121, 122 are adjusted so as to satisfy the formulas (3) and (4), during a time period from the moment of starting of the pumps to until the pumps are brought into steady operating states.

In the present embodiment, each ink-jet head 10 is elongate in the primary scanning direction, and the ink supply port 71*a* and the ink discharge port 71*b* are located at the respective longitudinal opposite ends of the head 10 as seen in the primary scanning direction. In the elongate head 10, the foreign matters can be effectively removed from the internal passage 82, by performing the maintenance operation wherein the ink is fed from the ink supply port 71*a* at one of the longitudinal ends of the head 10 to the ink discharge port 71*b* at the other longitudinal end, without the ink ejection from the nozzles 8.

In a first modification of the above-described embodiment wherein the pressurizing pump 121 and the suction pump 122 are controlled during the maintenance operation so as to satisfy the above-indicated formulas (3) and (4), the pumps 121, 122 are controlled by the controller 100 so as to satisfy the following formulas (5) and (6), wherein $P_3$ representing a meniscus-withstanding pressure at the filter 73*f* is used in place of the meniscus-withstanding pressures $P_0$ and $P_0'$ used in the formulas (3) and (4). The formulas (5) and (6) are obtained from the above-described formulas (A)-(D), according to the same principle as described above. In the present modification wherein the pressure P acts on the upper surface of the filter 73*f* is a positive value, the meniscus-withstanding pressure value $-P_0'$ in the formula (A) is omitted, and the pressure value $-P_0'(R_3+R_4)$ in the formula (3) is not present in the formula (5).

$$P_1R_4+P_2R_3<P_3(R_3+R_4) \quad \text{Formula (5)}$$

$$P_1-P_2>Q_1(R_3+R_4) \quad \text{Formula (6)}$$

Unlike the embodiment wherein the formulas (3) and (4) are satisfied, the present modification is based on the meniscus-withstanding pressure at the filter 73*f*, and the pumps 121, 122 are controlled during the maintenance operation so as to satisfy the above-indicated formulas (5) and (6), for preventing the destruction of the meniscus at the filter 73*f*, to thereby prevent an entry of the foreign matters (air bubbles, in particular) from the upstream passage 83 into the downstream passage 84 through the filter 73*f*, making possible to alleviate the problem of defective ejection of the ink from the nozzles 8 after the maintenance operation. In the present modification, a difference between the pressures $P_1$, $P_2$ has a larger amount of tolerance than in the above-described embodiment which is based on the meniscus-withstanding pressure at the nozzles 8. Accordingly, the operation to control the ink pressures at the ink supply and discharge ports 71*a*, 71*b* can be made easier, and the controller 100 can be made simpler in construction and more inexpensive.

Figure 7:
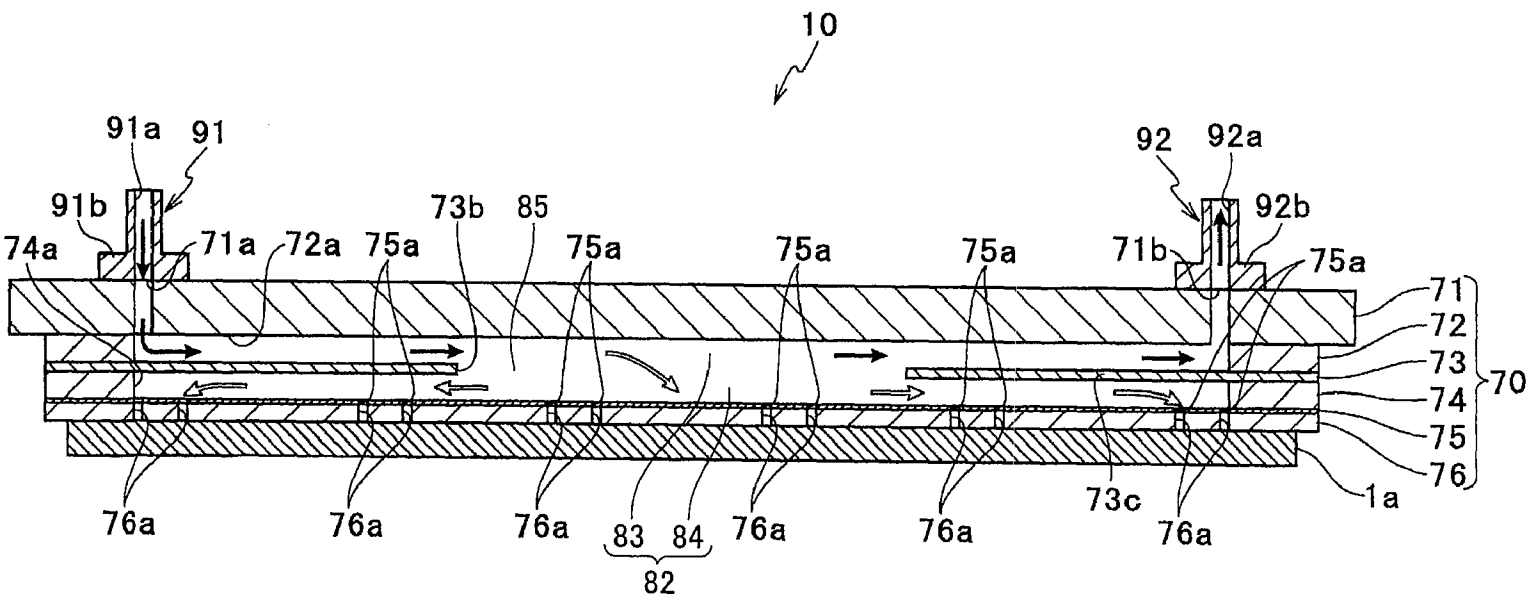
FIG. 7 is a view corresponding to that of FIG. 6, showing a modification of the embodiment of FIGS. 1-6.

In a second modification of the above-described embodiment, the ink-jet head 10 is not provided with the filter 73*f* in the internal passage 82, as shown in FIG. 7. In this second modification, the pressuring pump 121 and the suction pump 122 are controlled during the maintenance operation, so as to satisfy the following formulas (1) and (2), for preventing the destruction of the meniscus of the nozzles 8. It will be understood that the internal passage 82 has an intermediate part 85 which is a part of the internal passage 82, which is other than the end parts close to the ink supply port 71*a*, ink discharge port 71*b* and nozzles 8. Described more specifically, the intermediate part 85 is a part of the internal passage 82, which includes a point at which the passage between the ink supply port 71*a* and the nozzles 8 branches or diverges from the passage between the ink supply port 71*a* and the ink discharge port 71*b*. In other words, the intermediate part 85 is intermediate between the upstream ink reservoir 72*a* and the downstream ink reservoir 74*a*, as indicated in FIG. 7.

$$-P_0'(R_1+R_2)<P_1R_2+P_2R_1<P_0(R_1+R_2) \quad \text{Formula (1)}$$

$$P_1-P_2>Q_0(R_1+R_2) \quad \text{Formula (2)}$$

wherein ink flow resistance in a passage from the ink supply port 71*a* to the intermediate part 85 of the internal passage 82; $R_2$: ink flow resistance in a passage from the intermediate part 85 of the internal passage 82 to the ink discharge port 71*b*, and $Q_0$: minimum amount of ink supplied through the ink supply port 71*a* and discharged through the ink discharge port 71*b*, which minimum amount is required to discharge the foreign matters existing in a passage from the ink supply port 71*a* to the ink discharge port 71*b* via the intermediate part 85, during the maintenance operation.

There will be described manners in which the above-indicated formulas (1) and (2) are obtained.

To prevent the destruction of the meniscus of the nozzles 8 during the maintenance operation, the following formula (A') should be satisfied:

$$-P_0'<P'<P_0, \quad \text{Formula (A')}$$

wherein P': pressure acting on the nozzles 8; and $P_0$ and $P_0'$: meniscus-withstanding pressures of the nozzles 8.

The pressure P' has a positive value when the pressure P' acts in the direction from the side of the head 10 toward the atmosphere side. The meniscus-withstanding pressures, which are physical values relating to only the magnitude of a force (withstanding force), are given the positive and negative signs when the meniscus-withstanding pressures are compared with characteristic values (pressure P) indicated together with the direction in which the force acts. The meniscus-withstanding pressures have negative values when the force acts in the direction from the atmosphere side toward the head side.

An amount q' of the ink supplied through the ink supply port 71*a* and discharged from the ink discharge port 71*b* through the intermediate part 85 is represented by the following formula (B'), and the pressure P' acting on the nozzles 8 is represented by the following formula (C'):

$$q'=(P_1-P_2)/(R_1+R_2) \quad \text{Formula (B')}$$

$$P'=P_2+q'R_2 \quad \text{Formula (C')}$$

To discharge the foreign matters existing in the passage from the ink supply port 71*a* to the ink discharge port 71*b* via the intermediate part 85, the above-indicated ink amount q' should be larger than the above-indicated required minimum ink amount $Q_0$, so that the following formula (D') is obtained:

$$q'>Q_0 \quad \text{Formula (D')}$$

The above-indicated formula (1) is obtained from the above-indicated formulas (A'), (B') and (C'), while the above-indicated formula (2) is obtained from the above-indicated formulas (B') and (D').

According to the present second modification wherein the head 10 is not provided with the filter 73*f* it is possible to effectively prevent the destruction of the meniscus of the nozzles 8, by controlling the pressurizing pump 121 and the suction pump 122 so as to satisfy the above-indicated formulas (1) and (2), so that it is possible to prevent the ink leakage from the nozzles 8 and instability of ejection of the ink from the nozzles 8 after the maintenance operation, and to alleviate the problem of defective ejection of the ink after the maintenance operation.

The values $P_0$, $P_0'$, $P_3$, $R_1$, $R_2$, $R_3$, $R_4$, $Q_0$ and $Q_1$ in the formulas (1)-(6) are determined by the design of the passage system, or by actual measurements. For example, the values $P_0$, $P_0'$ and $P_3$ depend upon the inside diameter of the nozzles 8 and the size of mesh openings of the filter 73*f*, and the values $R_1$, $R_2$, $R_3$ and $R_4$ depend upon the geometric configuration and wall material of the internal passage 82, while the values $Q_0$ and $Q_1$ depend upon the geometric configuration of the internal passage 82, composition of the ink (liquid), and kind and size of the foreign matters that should be removed during the maintenance operation.

While the preferred embodiment of the invention and the modifications thereof have been described above, it is to be understood that the present invention is not limited to the details of the illustrated embodiment and modifications, but may be embodied with various changes and modifications.

In the illustrated embodiment, the pumps 121, 122 are respectively connected to the ink supply and discharge ports 71*a*, 71*b* through the respective tubes 110, 111. However, connecting members other than the tubes may be used for connection of the pumps 121, 122 to the ink supply and discharge ports 71*a*, 71*b*. Further, the pumps 121, 122 may be connected directly to the ink supply and discharge ports 71*a*, 71*b*, without using any connecting members. Various devices other than the pumps 121, 122 may be provided as the pressurizing portion.

In the illustrated embodiment, the two pumps 121, 122 are provided to apply pressures to both of the ink supply port 71*a* and the ink discharge port 71*b* of the head 10. However, a pump may be provided to apply a pressure to only one of the ink supply and discharge ports 71*a*, 71*b*. or any pressurizing device other than the pump may be used as the pressuring portion configured to apply the pressure to one of the ports 71*a*, 71*b*. Where the ink reservoir 101 is a flexible bag, for instance, such other pressuring device may be a spring device or a solenoid-operated device arranged to squeeze the flexible bag. In this case, the pressuring device is controlled so as to satisfy the above-indicated two formulas (1) and (2), two formulas (3) and (4), or two formulas (5) and (6), while the other of the ink supply and discharge ports 71*a*, 71*b* is kept at the atmospheric pressure, or at a pressure equal to the back pressure within the ink reservoir 101 in the form of the flexible bag.

In the illustrated embodiment, the pressurizing portion in the form of the pumps 121, 122 is controlled so as to satisfy the two formulas (1) and (2); (3) and (4); or (5) and (6). However, the pressurizing portion such as a pump or pumps may be designed so as to satisfy the formulas, or the passage system within the head 10 may be designed so as to satisfy the formulas.

The structural arrangement of each ink-jet head 10 is not limited to that in the illustrated embodiment. For example, the head 10 need not be elongate in one direction, and the passage system within the head 10 may be modified as desired, in connection with the positions of the ink supply port 71*a*, ink discharge port 71*b* and filter 73*f*. While the filter 73*f* is not provided in the second modification described above, two or more filters may be provided within the head 10.

Although the ink is discharged during the maintenance operation in the illustrated embodiment, any other liquid such as an exclusive cleaning liquid or solution may be used in place of the ink.

The liquid ejecting apparatus according to the present invention is not limited to the ink-jet type, but may be of any other type such as a thermal type, and may be of a line or serial type. Further, the liquid ejecting apparatus of the invention is not limited to the printer, but may be used as a facsimile apparatus (telecopier) or a copying apparatus.

What is claimed is:

1. A method of controlling a liquid ejecting apparatus including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, and an internal passage including a passage from the liquid supply portion to the liquid ejecting portion through an intermediate part, and a passage extending from the intermediate part to the liquid discharge portion, and (b) a pressurizing portion configured to apply a pressure to at least one of the liquid supply portion and the liquid discharge portion, said method comprising:

controlling the pressurizing portion so as to satisfy the following formulas (1) and (2), during a maintenance operation wherein the liquid supplied through the liquid supply portion is discharged from the liquid discharge portion, without a flow of the liquid through the liquid ejecting portion, $$-P_0'(R_1+R_2)<P_1R_2+P_2R_1<P_0(R_1+R_2) \quad \text{formula (1)}$$

$$P_1-P_2>Q_0(R_1+R_2) \quad \text{formula (2)}$$

wherein $P_0$: meniscus-withstanding pressure of the liquid ejecting portion in a direction from a side of the liquid toward a side of an atmosphere, $P_0'$: meniscus-withstanding pressure of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_1$: liquid flow resistance in a passage from the liquid supply portion to the intermediate part of the internal passage, $R_2$: liquid flow resistance in a passage from the intermediate part of the internal passage to the liquid discharge portion, and $Q_0$: minimum amount of liquid supplied through the liquid supply portion and discharged through the liquid discharge portion, which minimum amount is required to discharge foreign matters existing in a passage from the liquid supply portion to the liquid discharge portion via the intermediate part during the maintenance operation.

2. The method according to claim 1, further comprising controlling the pressurizing portion to operate during the maintenance operation to apply pressures to both the liquid supply portion and the liquid discharge portion.

3. The method according to claim 1, wherein the pressurizing portion is a pump.

4. The method according to claim 1, further comprising controlling the pressurizing portion during the maintenance operation so as to satisfy the formulas (1) and (2).

5. The method according to claim 1, wherein the liquid ejecting head is elongate in one direction, and the liquid supply portion and the liquid discharge portion are located at respective longitudinal opposite ends of the liquid ejecting head as seen in said one direction.

6. A method of controlling a liquid ejecting apparatus including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion, and (b) a pressurizing portion configured to apply a pressure to at least one of the liquid supply portion and the liquid discharge portion, said method comprising:

controlling the pressurizing portion so as to satisfy the following formulas (3) and (4), during a maintenance operation wherein the liquid supplied through the liquid supply portion is discharged from the liquid discharge portion through the upstream passage, $$-P_0'(R_3+R_4)<P_1R_4+P_2R_3<P_0(R_3+R_4) \quad \text{formula (3)}$$

$$P_1-P_2>Q_1(R_3+R_4) \quad \text{formula (4)}$$

wherein $P_0$: meniscus-withstanding pressure of the liquid ejecting portion in a direction from a side of the liquid toward a side of an atmosphere, $P_0'$: meniscus-withstanding pressure of the liquid ejecting portion in a direction from the side of the atmosphere toward the side of the liquid, $P_1$: pressure at the liquid supply portion during the maintenance operation, $P_2$:

pressure at the liquid discharge portion during the maintenance operation, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

7. The method according to claim 6, further comprising controlling the pressurizing portion during the maintenance operation to apply pressures to both the liquid supply portion and the liquid discharge portion.

8. The method according to claim 6, wherein the pressurizing portion is a pump.

9. The method according to claim 6, further comprising controlling the pressurizing portion during the maintenance operation so as to satisfy the formulas (3) and (4).

10. The method according to claim 6, wherein the liquid ejecting head is elongate in one direction, and the liquid supply portion and the liquid discharge portion are located at respective longitudinal opposite ends of the liquid ejecting head as seen in said one direction.

11. A method of controlling a liquid ejecting apparatus including (a) a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion, and (b) a pressurizing portion configured to apply a pressure to at least one of the liquid supply portion and the liquid discharge portion, said method comprising:

controlling the pressurizing portion so as to satisfy the following formulas (5) and (6), during a maintenance operation wherein the liquid supplied through the liquid supply portion is discharged from the liquid discharge portion through the upstream passage, $$P_1R_4+P_2R_3<P_3(R_3+R_4) \quad \text{formula (5)}$$

$$P_1-P_2>Q_1(R_3+R_4) \quad \text{formula (6)}$$

wherein $P_1$: pressure at the liquid supply portion during the maintenance operation, $P_2$: pressure at the liquid discharge portion during the maintenance operation, $P_3$: meniscus-withstanding pressure at the filter portion, $R_3$: liquid flow resistance in a passage from the liquid supply portion to the filter portion, $R_4$; liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

12. The method according to claim 11, further comprising controlling the pressurizing portion during the maintenance operation to apply pressures to both the liquid supply portion and the liquid discharge portion.

13. The method according to claim 11, wherein the pressurizing portion is a pump.

14. The method according to claim 11, further comprising controlling the pressurizing portion during the maintenance operation so as to satisfy the formulas (5) and (6).

15. The method according to claim 11, wherein the liquid ejecting head is elongate in one direction, and the liquid supply portion and the liquid discharge portion are located at respective longitudinal opposite ends of the liquid ejecting head as seen in said one direction.

16. A liquid ejecting apparatus comprising:

a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, and an internal passage including a passage extending from the liquid supply portion to the liquid ejecting portion through an intermediate part, and a passage extending from the intermediate part to the liquid discharge portion;

a pressurizing portion configured to apply a pressure to at least one of the liquid supply portion and the liquid discharge portion; and a control portion configured to control the pressurizing portion so as to satisfy the following formulas (1) and (2), during a maintenance operation wherein the liquid supplied through the liquid supply portion is discharged from the liquid discharge portion, without a flow of the liquid through the liquid ejecting portion, $$-P_0'(R_1+R_2)<P_1R_2+P_2R_1<P_0(R_1+R_2) \quad \text{formula (1)}$$

$$P_1-P_2>Q_0(R_1+R_2) \quad \text{formula (2)}$$

wherein $P_0$: meniscus-withstanding pressure of the liquid ejecting portion in a direction from a side of the liquid toward a side of an atmosphere, $P_0'$: meniscus-withstanding pressure of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_1$: liquid flow resistance in a passage from the liquid supply portion to the intermediate part of the internal passage, $R_2$: liquid flow resistance in a passage from the intermediate part of the internal passage to the liquid discharge portion, and $Q_0$: minimum amount of liquid supplied through the liquid supply portion and discharged through the liquid discharge portion, which minimum amount is required to discharge foreign matters existing in a passage from the liquid supply portion to the liquid discharge portion via the intermediate part during the maintenance operation.

17. The liquid ejecting apparatus according to claim 16, wherein the pressurizing portion is operated during the maintenance operation to apply pressures to both the liquid supply portion and the liquid discharge portion.

18. The liquid ejecting apparatus according to claim 16, wherein the pressurizing portion is a pump.

19. The liquid ejecting apparatus according to claim 16, wherein the pressurizing portion is controlled during the maintenance operation so as to satisfy the formulas (1) and (2).

20. The liquid ejecting apparatus according to claim 16, wherein the liquid ejecting head is elongate in one direction, and the liquid supply portion and the liquid discharge portion are located at respective longitudinal opposite ends of the liquid ejecting head as seen in said one direction.

21. A liquid ejecting apparatus comprising:

a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion;

a pressurizing portion configured to apply a pressure to at least one of the liquid supply portion and the liquid discharge portion; and a control portion configured to control the pressurizing portion so as to satisfy the following formulas (3) and (4), during a maintenance operation wherein the liquid supplied through the liquid supply portion is discharged from the liquid discharge portion through the upstream passage, $$-P_0'(R_3+R_4)<P_1R_4+P_2R_3<P_0(R_3+R_4) \quad \text{formula (3)}$$

$$P_1-P_2>Q_1(R_3+R_4) \quad \text{formula (4)}$$

wherein $P_0$: meniscus-withstanding pressure of the liquid ejecting portion in a direction from a side of the liquid toward a side of an atmosphere, $P_0'$: meniscus-withstanding pressure of the liquid ejecting portion in a direction from the side of the atmosphere toward the side of the liquid, $P_1$: pressure at the liquid supply portion during the maintenance operation, $P_2$: pressure at the liquid discharge portion during the maintenance operation, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

22. The liquid ejecting apparatus according to claim 21, wherein the pressurizing portion is operated during the maintenance operation to apply pressures to both the liquid supply portion and the liquid discharge portion.

23. The liquid ejecting apparatus according to claim 21, wherein the pressurizing portion is a pump.

24. The liquid ejecting apparatus according to claim 21, wherein the pressurizing portion is controlled during the maintenance operation so as to satisfy the formulas (3) and (4).

25. The liquid ejecting apparatus according to claim 21, wherein the liquid ejecting head is elongate in one direction, and the liquid supply portion and the liquid discharge portion are located at respective longitudinal opposite ends of the liquid ejecting head as seen in said one direction.

26. A liquid ejecting apparatus comprising:

a liquid ejecting head having a liquid supply portion through which a liquid is supplied to the liquid ejecting head, a liquid ejecting portion through which the liquid supplied through the liquid supply portion is ejected from the liquid ejecting head, a liquid discharge portion through which the liquid supplied through the liquid supply portion is discharged from the liquid ejecting head, an internal passage including a passage from the liquid supply portion to the liquid ejecting portion and a passage from the liquid supply portion to the liquid discharge portion, and a filter portion which divides the internal passage into an upstream passage communicating with the liquid supply portion and the liquid discharge portion and a downstream passage communicating with the liquid ejecting portion;

a pressurizing portion configured to apply a pressure to at least one of the liquid supply portion and the liquid discharge portion; and a control portion configured to control the pressurizing portion so as to satisfy the following formulas (5) and (6), during a maintenance operation wherein the liquid supplied through the liquid supply portion is discharged from the liquid discharge portion through the upstream passage, $$P_1R_4+P_2R_3<P_3(R_3+R_4) \quad \text{formula (5)}$$

$$P_1-P_2>Q_1(R_3+R_4) \quad \text{formula (6)}$$

wherein $P_1$: pressure at the liquid supply portion during the maintenance operation, $P_2$: pressure at the liquid discharge portion during the maintenance operation, $P_3$: meniscus-withstanding pressure at the filter portion, $R_3$: liquid flow resistance in a passage from the liquid supply portion to the filter portion, $R_4$: liquid flow resistance in a passage from the filter portion to the liquid discharge portion, and $Q_1$: minimum amount of liquid supplied through the liquid supply portion and discharged through the liquid discharge portion, which minimum amount is required to discharge foreign matters existing in the upstream passage during the maintenance operation.

27. The liquid ejecting apparatus according to claim 26, wherein the pressurizing portion is operated during the maintenance operation to apply pressures to both the liquid supply portion and the liquid discharge portion.

28. The liquid ejecting apparatus according to claim 26, wherein the pressurizing portion is a pump.

29. The liquid ejecting apparatus according to claim 26, wherein the pressurizing portion is controlled during the maintenance operation so as to satisfy the formulas (5) and (6).

30. The liquid ejecting apparatus according to claim 26, wherein the liquid ejecting head is elongate in one direction, and the liquid supply portion and the liquid discharge portion are located at respective longitudinal opposite ends of the liquid ejecting head as seen in said one direction.

* * * * *

UNITED STATES PATENT AND TRADEMARK OFFICE

CERTIFICATE OF CORRECTION

PATENT NO. : 8,267,497 B2
APPLICATION NO. : 12/503873
DATED : September 18, 2012
INVENTOR(S) : Atsushi Hirota It is certified that error appears in the above-identified patent and that said Letters Patent is hereby corrected as shown below:

On the Title Page, under item [57] Abstract:

Please delete "includes, and a control" and insert -- includes a control --

Signed and Sealed this
Fourth Day of June, 2013

Teresa Stanek Rea

Teresa Stanek Rea
*Acting Director of the United States Patent and Trademark Office*